US010361518B2

(12) United States Patent
Zhang et al.

(10) Patent No.: US 10,361,518 B2
(45) Date of Patent: Jul. 23, 2019

(54) ELECTRICAL CONNECTOR HAVING SHIELDING PLATE RETAINED TIGHTLY THERETO

(71) Applicant: FOXCONN INTERCONNECT TECHNOLOGY LIMITED, Grand Cayman (KY)

(72) Inventors: Teng-Fei Zhang, Kunshan (CN); Jian-Kuang Zhu, Kunshan (CN); Kuo-Chun Hsu, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/828,319

(22) Filed: Nov. 30, 2017

(65) Prior Publication Data

US 2018/0151985 A1 May 31, 2018

(30) Foreign Application Priority Data

Nov. 30, 2016 (CN) ..... 2016 2 1297676 U

(51) Int. Cl.
*H01R 24/60* (2011.01)
*H01R 107/00* (2006.01)
(Continued)

(52) U.S. Cl.
CPC ..... *H01R 13/6582* (2013.01); *H01R 12/716* (2013.01); *H01R 13/516* (2013.01);
(Continued)

(58) Field of Classification Search
CPC .. H01R 24/60; H01R 13/6275; H01R 13/648; H01R 13/6581; H01R 13/6582; H01R 13/6583; H01R 13/6585
See application file for complete search history.

(56) References Cited

U.S. PATENT DOCUMENTS 9,281,642 B1 * 3/2016 Tseng ..... H01R 24/60
9,553,409 B2 * 1/2017 Deng ..... H01R 13/6581
(Continued)

FOREIGN PATENT DOCUMENTS

CN 204030066 U 12/2014
CN 204376105 U 6/2015
(Continued)

*Primary Examiner* — James Harvey
*Assistant Examiner* — Oscar C Jimenez
(74) *Attorney, Agent, or Firm* — Wei Te Chung; Ming Chieh Chang

(57) ABSTRACT

An electrical connector includes an insulative housing defining a mating chamber opening forwardly along a front-to-back direction, a number of contacts retained to the insulative housing, and a shielding plate having a pair of latch arms located at two opposite lateral sides of the mating chamber. Each of the contacts includes a contact portion extending into the mating chamber. The shielding plate includes a pair of retention arms each including an interference protrusion engaged with the insulative housing by interference fit. The interference protrusions are disposed in a face-to-face way to engage with a rear wall of the insulative housing so that the interference protrusions are retained tightly to insulative housing and less likely to damage the insulative housing.

20 Claims, 12 Drawing Sheets

(51) Int. Cl.

| | |
|---|---|
| ***H01R 13/627*** | (2006.01) |
| ***H01R 13/6582*** | (2011.01) |
| ***H01R 13/6583*** | (2011.01) |
| ***H01R 13/6585*** | (2011.01) |
| ***H01R 13/6596*** | (2011.01) |
| ***H01R 12/71*** | (2011.01) |
| ***H01R 13/516*** | (2006.01) |
| *H01R 12/72* | (2011.01) |

(52) U.S. Cl.
CPC ..... *H01R 13/6275* (2013.01); *H01R 13/6583* (2013.01); *H01R 13/6585* (2013.01); *H01R 13/6596* (2013.01); *H01R 12/724* (2013.01); *H01R 24/60* (2013.01); *H01R 2107/00* (2013.01)

(56) References Cited

U.S. PATENT DOCUMENTS

| | | | | |
|---|---|---|---|---|
| 9,685,740 | B1 * | 6/2017 | Hsu | H01R 13/6585 |
| 9,705,217 | B2 * | 7/2017 | Ju | H01R 24/78 |
| 9,711,910 | B2 * | 7/2017 | Zhao | H01R 13/6581 |
| 9,917,391 | B2 * | 3/2018 | Zhang | H01R 13/04 |
| 10,096,949 | B2 * | 10/2018 | Zhang | H01R 12/707 |
| 2011/0250795 | A1 * | 10/2011 | Su | H01R 4/26 439/660 |
| 2015/0194770 | A1 * | 7/2015 | Little | H01R 13/6582 439/607.27 |
| 2015/0214674 | A1 * | 7/2015 | Simmel | H01R 13/659 439/607.35 |
| 2016/0020569 | A1 * | 1/2016 | Ju | H01R 24/78 439/607.01 |
| 2016/0036167 | A1 * | 2/2016 | Kuang | H01R 24/60 439/607.34 |
| 2016/0049756 | A1 * | 2/2016 | Yen | H01R 13/6585 439/676 |
| 2016/0156136 | A1 * | 6/2016 | Kao | H01R 13/6585 439/607.05 |
| 2016/0181743 | A1 * | 6/2016 | Tsai | H01R 12/724 439/587 |
| 2016/0233617 | A1 * | 8/2016 | Yen | H01R 13/6275 |
| 2016/0276782 | A1 * | 9/2016 | Chang | H01R 13/6585 |
| 2016/0380389 | A1 * | 12/2016 | Ju | H01R 13/6585 439/607.05 |
| 2017/0047691 | A1 * | 2/2017 | Lin | H01R 13/6585 |
| 2017/0149164 | A1 * | 5/2017 | Yokoyama | H01R 13/42 |
| 2017/0271822 | A1 * | 9/2017 | Zhang | H01R 12/7082 |
| 2017/0302014 | A1 * | 10/2017 | Ju | H01R 24/78 |
| 2017/0310501 | A1 * | 10/2017 | Wang | H01R 12/7023 |
| 2017/0346237 | A1 * | 11/2017 | Ju | H01R 13/6585 |
| 2017/0373438 | A1 * | 12/2017 | Qiu | H01R 13/6581 |
| 2018/0026410 | A1 * | 1/2018 | Tsai | H01R 13/502 439/607.09 |
| 2018/0109042 | A1 * | 4/2018 | Little | H01R 13/405 |
| 2018/0115118 | A1 * | 4/2018 | Zhao | H01R 13/6585 |
| 2018/0159278 | A1 * | 6/2018 | Zhao | H01R 13/6585 |

FOREIGN PATENT DOCUMENTS

| | | | |
|---|---|---|---|
| CN | 204516964 | U | 7/2015 |
| CN | 204809555 | U | 11/2015 |
| TW | M500371 | U | 5/2015 |
| TW | M505078 | U | 7/2015 |
| TW | M521817 | U | 5/2016 |

* cited by examiner

ELECTRICAL CONNECTOR HAVING SHIELDING PLATE RETAINED TIGHTLY THERETO

BACKGROUND OF THE INVENTION

1. Field of the Invention

The present invention relates to an electrical connector with an insulative housing and a shielding plate retained tightly thereto.

2. Description of Related Art

China Patent No. CN204376105U discloses an electrical connector including a front insulator, a shielding plate retained to the front insulator, and a first contact module and a second contact module disposed at two opposite sides of the shielding plate. The front insulator includes a front face, a rear face and a pair of lateral sides connecting therebetween. The front insulator defines a mating chamber recessed backwardly from the front face and a receiving space recessed forwardly from the rear face. The shielding plate has a pair of latch arms extending into the mating chamber and a pair of retention arms received in the receiving space. Each of the latch arms includes a latch protrusion extending inwardly so that the latch protrusions disposed in a face-to-face way. Each of the retention arms has a fixing projection extending outwardly so that the fix projections disposed in a back-to-back way. The fixing projections engage with the lateral sides of the front insulator by interference fit. The lateral sides engaged with the fixing projections is thin, therefore the shielding plate maybe easily damage the lateral sides when the shielding plate is assembled to the front insulator, result in a poor retain force between the shielding plate and the front insulator.

SUMMARY OF THE INVENTION

Accordingly, the object of the present invention is to provide an electrical connector including an insulative housing defining a mating chamber opening forwardly along a front-to-back direction, a plurality of contacts retained to the insulative housing, and a shielding plate having a pair of latch arms located at two opposite lateral sides of the mating chamber. Each of the contacts includes a contact portion extending into the mating chamber. The shielding plate includes a pair of retention arms each including an interference protrusion fixed to the insulative housing. The interference protrusions are disposed in a face-to-face way to engage with a rear wall of the insulative housing so that the interference protrusions are retained tightly to insulative housing and less likely to damage the insulative housing.

Other objects, advantages and novel features of the invention will become more apparent from the following detailed description when taken in conjunction with the accompanying drawings.

DETAILED DESCRIPTION OF THE PREFERRED EMBODIMENT

Figure 1:
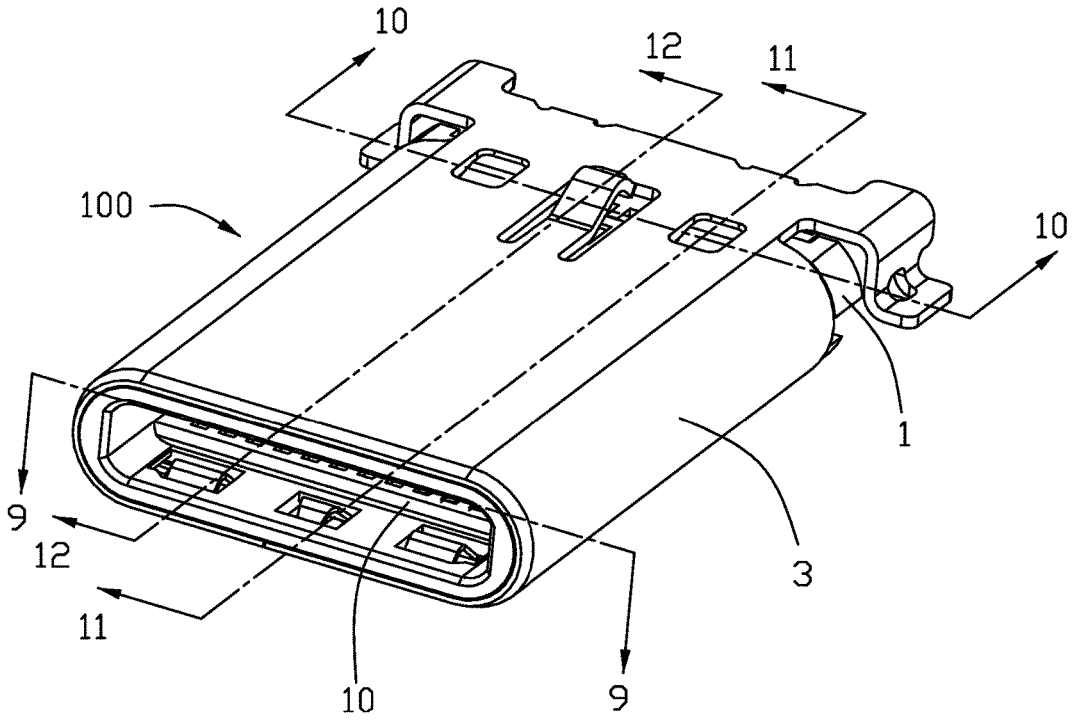
FIG. 1 is a perspective view of the electrical connector according to the invention.
Figure 2:
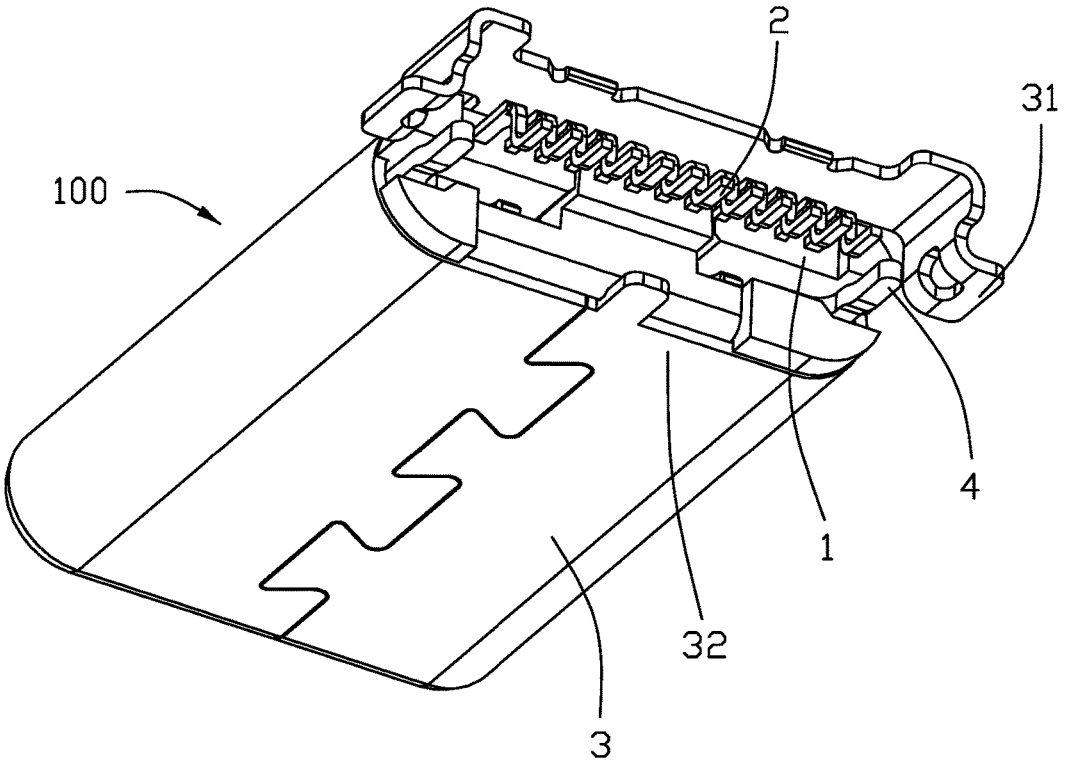
FIG. 2 is another perspective view of the electrical connector shown in FIG. 1.
Figure 3:
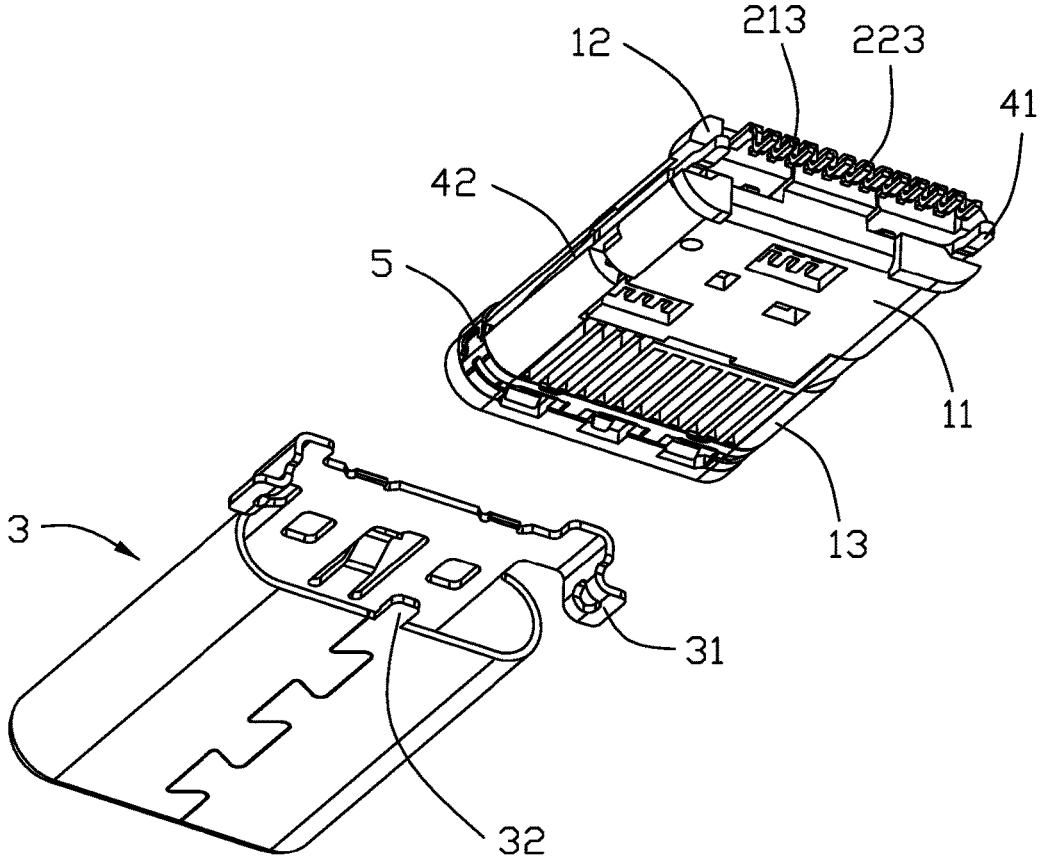
FIG. 3 is a partly exploded view of the electrical connector shown in FIG. 2.
Figure 4:
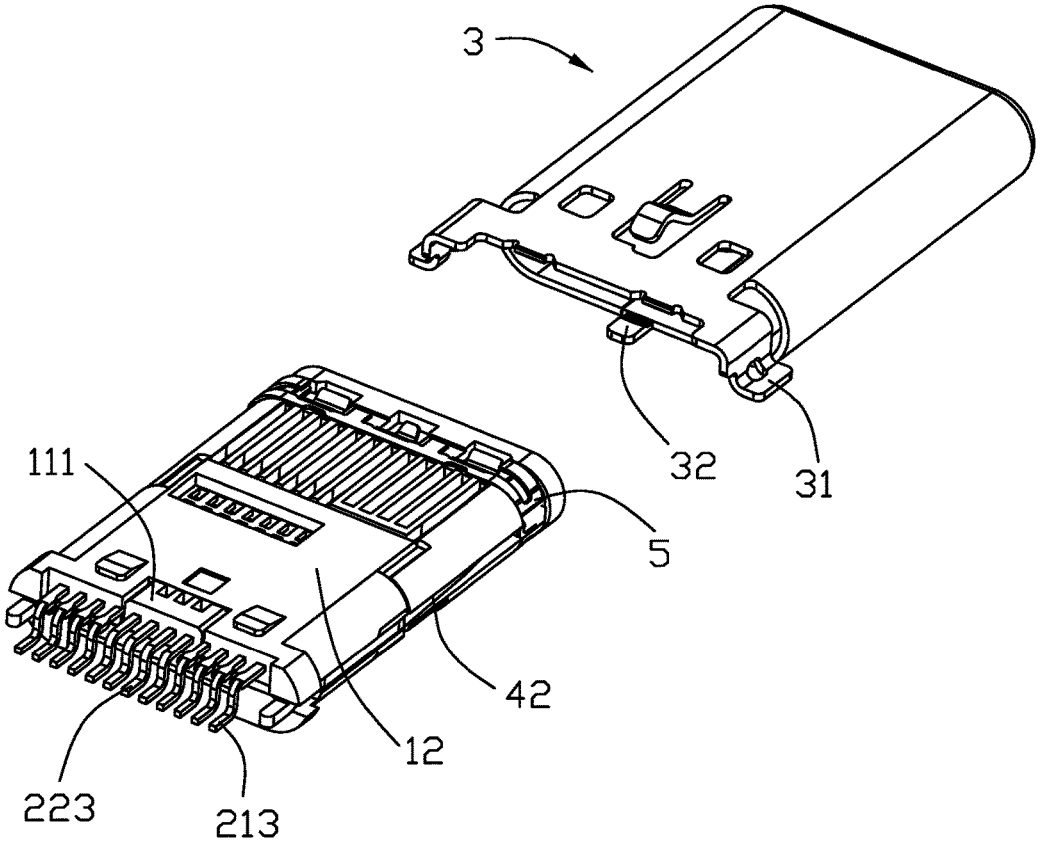
FIG. 4 is another partly exploded view of the electrical connector shown in FIG. 3.
Figure 5:
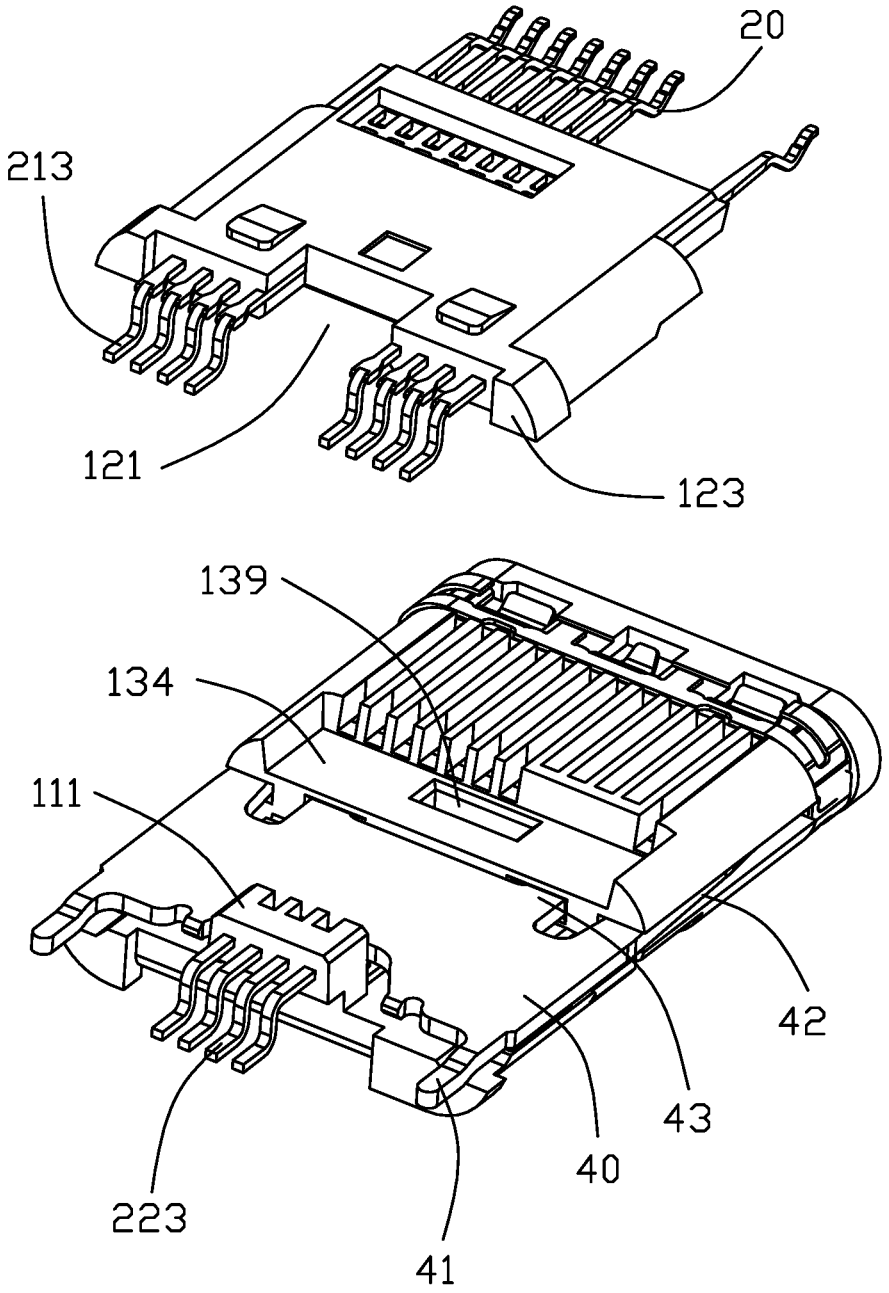
FIG. 5 is a further exploded view of the electrical connector shown in FIG. 4, wherein the metal shell is omitted.
Figure 6:
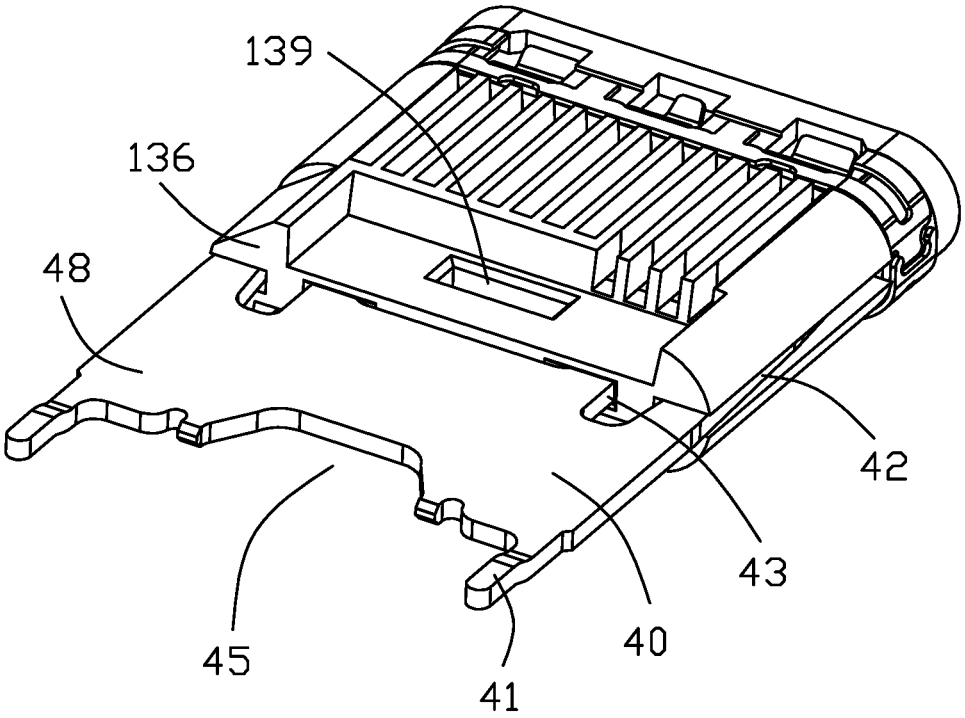
FIG. 6 is a further exploded view of the electrical connector shown in FIG. 5, wherein the first and second terminal modules are omitted.

Reference will now be made in detail to the preferred embodiment of the present invention. FIGS. 1-11 show an electrical connector 100 including an insulative housing 1, a plurality of contacts 2 retained to the insulative housing 1, a shielding plate 4, a grounding collar 5 surrounding around a front part of the insulative housing 1, and a metal shell 3 enclosing the insulative housing 1.

The insulative housing 1 includes a front insulator 13 with a mating chamber 10 opening forwardly along a front-to-back direction, a first rear insulator 11 and a second rear insulator 12 disposed at two opposite sides of the shielding plate 4. Each of the contacts 2 includes a contacting portion 20 extending into the mating chamber 10 and a soldering tail 213, 223 extending backwardly beyond the insulative housing 1. In the present embodiment, the soldering tails 213, 223 are arranged in a row along a transverse direction perpendicular to the front-to-back direction to be soldered to an exterior printed circuit board (PCB) by a surface mount technology (SMT). The shielding plate 4 includes a pair of latch arms 42 disposed at two lateral sides of the mating chamber 10 and a pair of connecting legs 41 extending backwardly beyond the insulative housing 1. The metal shell 3 has two soldering legs 31 located at two opposite side of the rear part thereof. The soldering tails 213, 223, the connecting legs 41 and the soldering legs 31 are disposed at a same level. The metal shell 3 has a supporting tab 32 extending backwardly from a bottom thereof to sandwich the PCB between the supporting tab 32 and the soldering legs 31.

Figure 7:
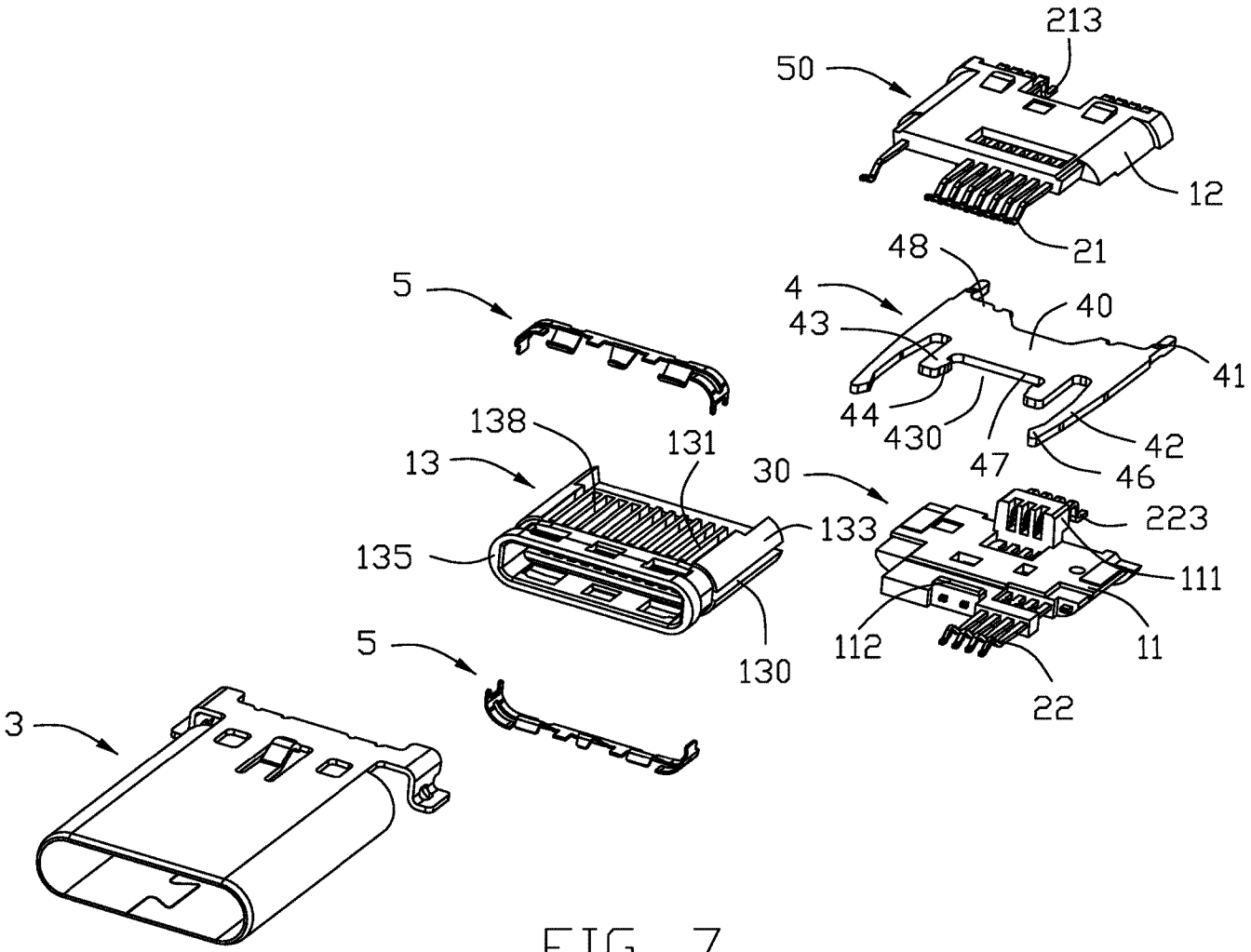
FIG. 7 is a partly exploded view of the electrical connector shown in FIG. 1.
Figure 8:
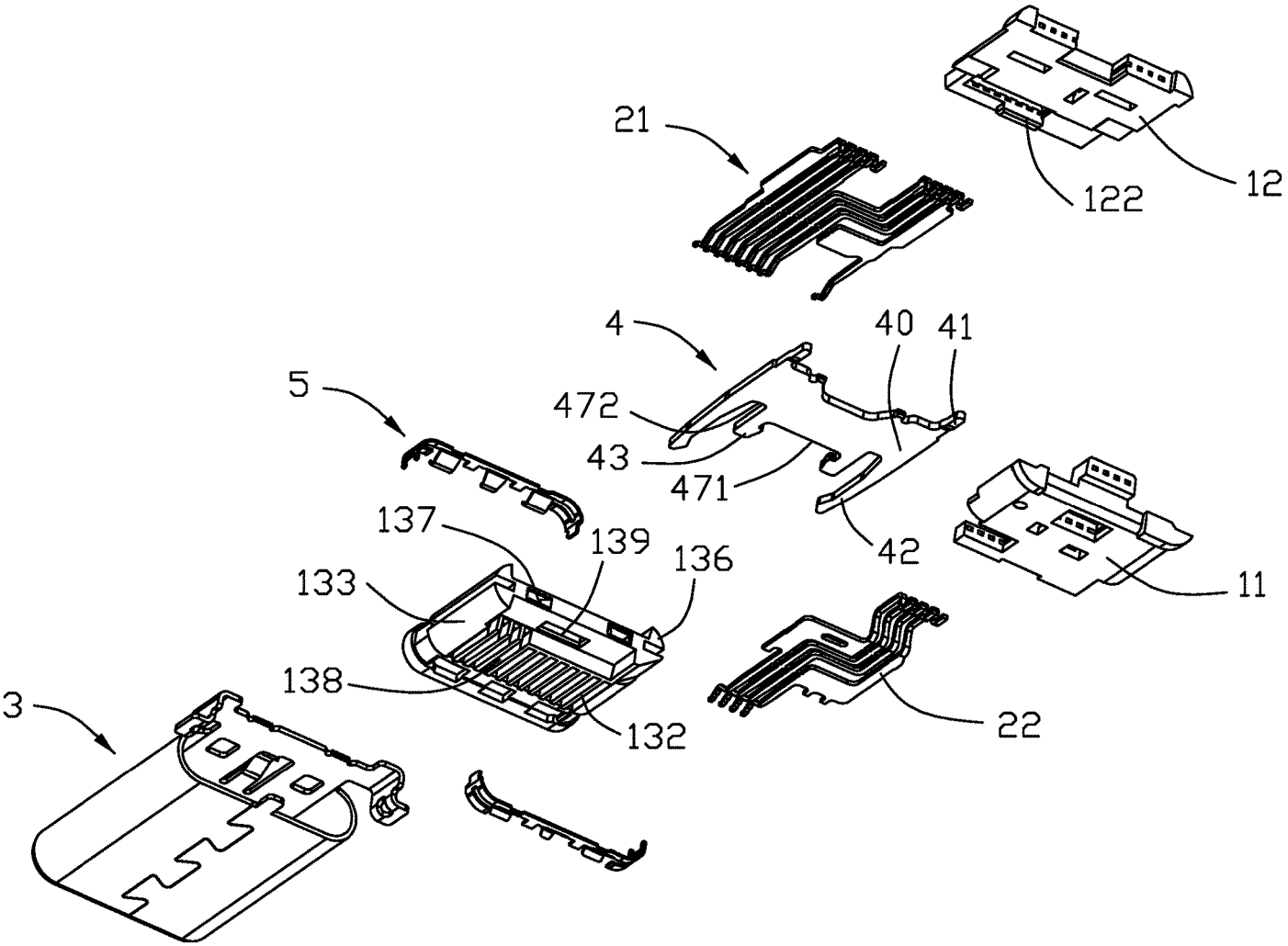
FIG. 8 is a further exploded view of the electrical connector shown in FIG. 8.
Figure 9:
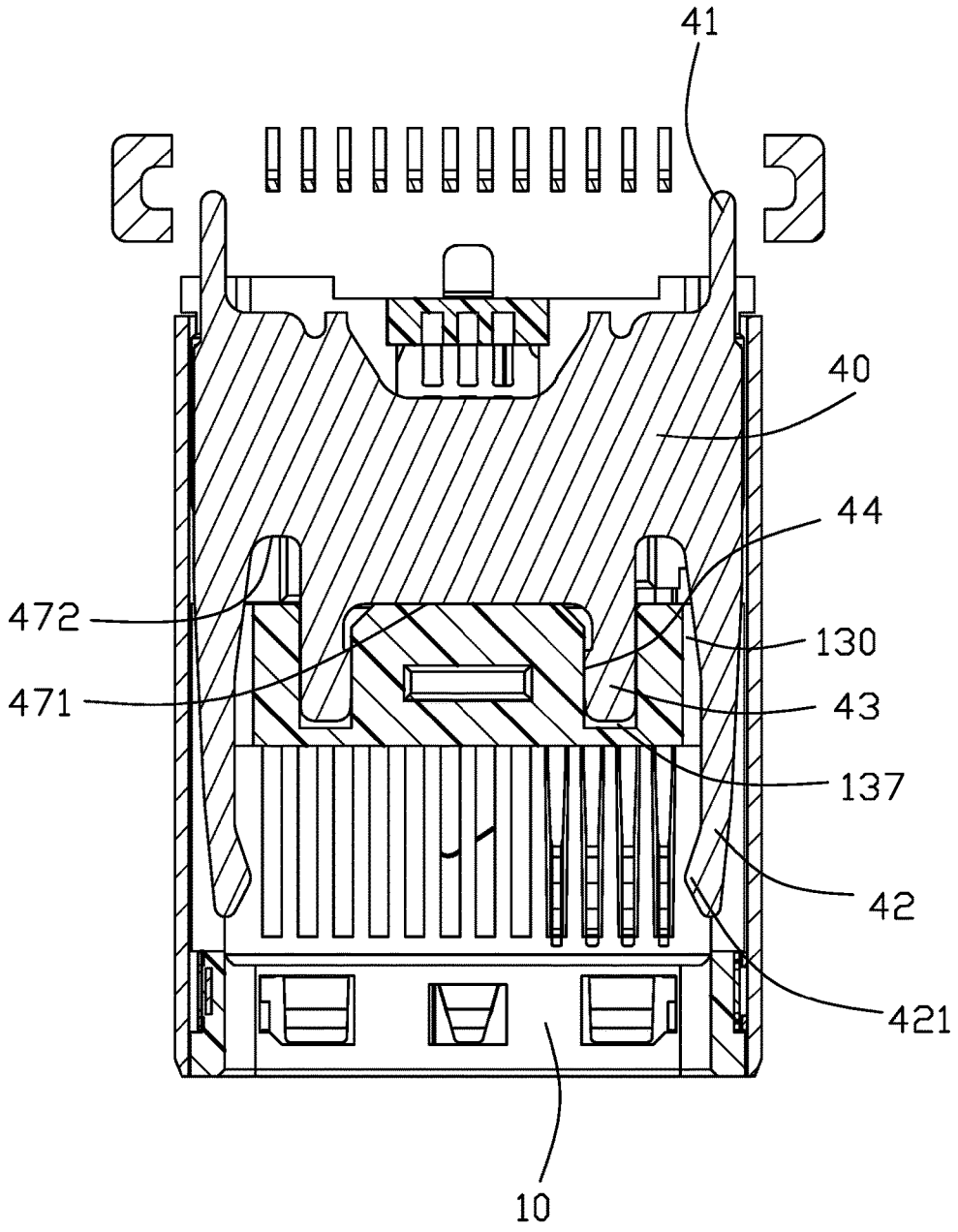
FIG. 9 is a cross-sectional view of the electrical connector of FIG. 1, taken along a line 9-9.
Figure 10:
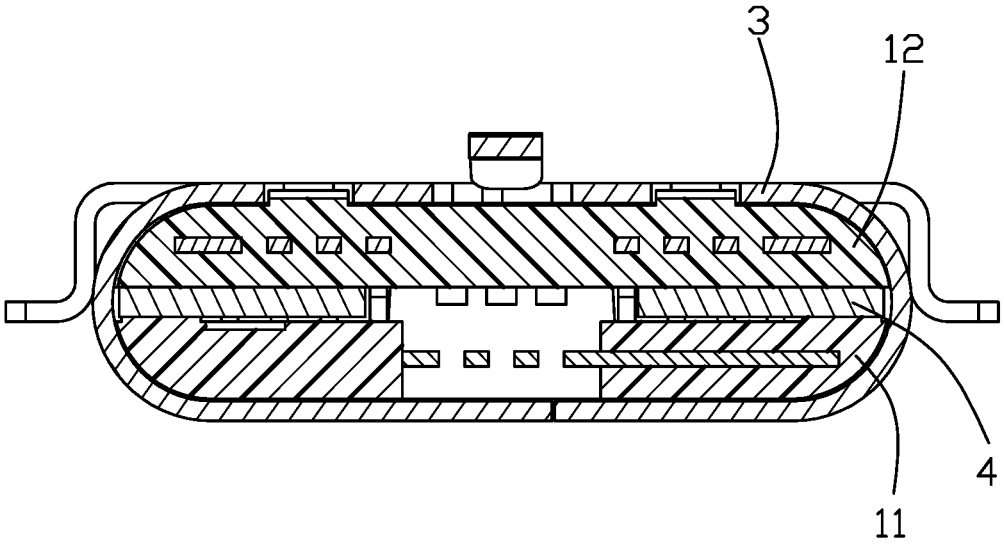
FIG. 10 is a cross-sectional view of the electrical connector of FIG. 1, taken along a line 10-10.
Figure 11:
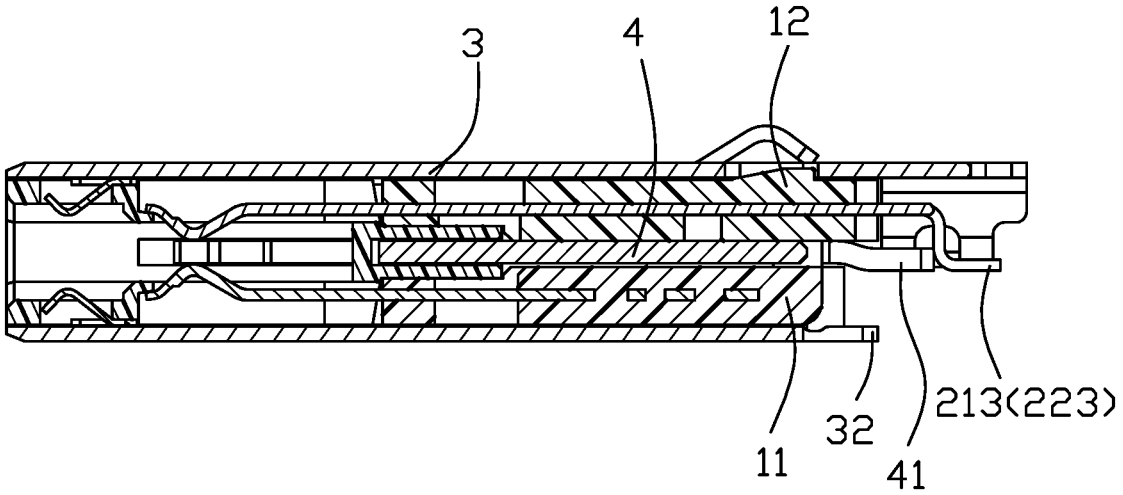
FIG. 11 is a cross-sectional view of the electrical connector of FIG. 1, taken along a line 11-11.
Figure 12:
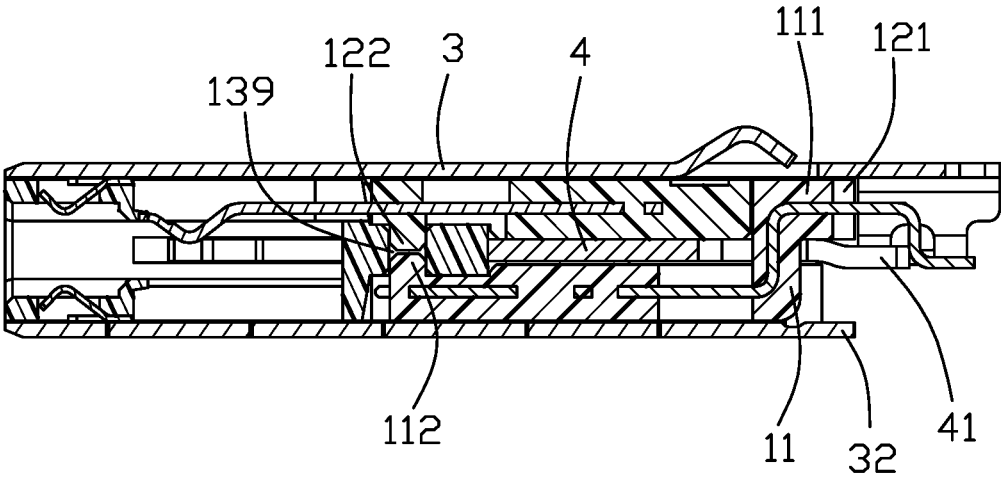
FIG. 12 is a cross-sectional view of the electrical connector of FIG. 1 along a line 12-12.

Referring to FIGS. 7-9, the front insulator 13 includes a top face 131, a bottom face 132, a front face 135, a rear face 136, and two lateral face 133 connecting between the top face 131 and the bottom face 132. The mating chamber 10 is recessed backwardly from the front face 135. Each of the top face 131 and the bottom face 132 defines a row of receiving grooves 138 going therethrough along a vertical direction perpendicular to both the front-to-back direction and the transverse direction, a receiving room 134 behind the receiving grooves 138, and a receiving slot 139 recessed vertically from the receiving room 134. A pair of fixing grooves 137 go through the rear face 136 of the front insulator 13 along the front-to-back direction. A pair of escape grooves 130 go through the lateral faces 133 along the transverse direction to communicate with the mating chamber 10, respectively. The escape grooves 130 also go through the rear face 136 along the front-to-back direction.

Referring to FIGS. 6-9, the shielding plate 4 has a planar body 40, a pair of latch arms 42 extending forwardly from the planar body 40, and a pair of connecting legs 41 extending backwardly from the planar body 40. A pair of retention arms 43 extend forwardly from the planar body 40 to engage with insulative housing 1 by interference fit. The retention arms 43 are located inside of the latch arms 42. The pair of retention arms 43 have two interference protrusions 44 extending inwardly, respectively, to be disposed in a face-to-face way. The retention arms 43 extend forwardly beyond a front surface 47 of the planar body 40 to form a retention cutout 430 therebetween. The front surface 47 includes a first front surface 471 located between the retention arms 43 and a second front surface 472 located outside of the retention arms 43. The first front surface 471 is front of the second front surface 472. A pair of extensions 48 extend backwardly from the planar body 40 to define a positioning slot 45 therebetween. When the shielding plate 4 is assembled forwardly to the front insulator 13, the retention arms 43 engage with the front insulator 13 by interference fit. More specifically, the retention arms 43 are received in the fixing grooves 137, respectively wherein the interference protrusions 44 are interference fit with the corresponding inner wall of the fixing grooves 137. The latch arms 42 are received in the corresponding escape grooves 130. A locking barb 46 extends inwardly from a front portion of the latch arm 42 into the mating chamber 10 to engage with a complementary connector. The first front surface 471 abuts against the rear face 136 of the front insulator 13. The second front surface 472 is spaced apart from the rear surface 136. Understandably, the shielding plate 4 is stably fixed to the front insulator 13 through the retention arms 43.

Referring to FIGS. 5-9, the contacts 2 include a row of first contacts 22 insert molded within the first rear insulator 11 to form a first contact module 30 and a row of second contacts 21 insert molded within the second insulator 12 to form a second contact module 50. The first contact module 30 and the second contact module 50 are assembled to two opposite sides/surfaces of the shielding plate 4 along the vertical direction. The extension 48 of the shielding plate 4 is sandwiched between the inner walls of the first rear insulator 11 and the second rear insulator 12. Each of the first rear insulator 11 and the second rear insulator 12 has a positioning projection 112, 122 inserted into the receiving slot 139 along the vertical direction. Each of the first contacts 22 includes a first soldering tail 223. Each of the second contacts 21 includes a second soldering tail 213. The first soldering tail 223 and the second soldering tail 213 are arranged in a row along the transverse direction. A positioning cutout 121 is recessed from a rear edge 123 of the first rear insulator 11. A positioning protrusion 111 is protruded from a top of the second rear insulator 12 to insert into the positioning cutout 121. The first soldering tails 213 extend backwardly from the positioning protrusion 111 to ensure the coplanarity of the first soldering portion 223 and the second soldering portion 213.

The retention arms 43 have two face-to-face interference protrusions 44 to lock the shielding plate 4 firmly with a rear wall of the front insulator 13. The shielding plate 4 is assembled to the front insulator 13 alone, and then the first contact module 30 and the second contact module 50 are assembled to the front insulator 13 and the shielding plate 4 so as to ensure the coplanarity of the first soldering portions 213 and the second soldering portions 223. The extension 48 urges the first rear insulator 11 and the second rear insulator 12 to tightly abut against to the shielding plate 4 to further ensure the coplanarity of first soldering portions 213 and the second soldering portions 223. In brief, the first insulator 11 or the first contact module 30 and the second insulator 12 of the second contact module 50 commonly sandwich the planar body 40 of the shielding plate 4 therebetween in the vertical direction to obtain the reliable support thereof so as to have the first soldering portions 213 and the second soldering portion 223 reliably coplanar with each other. Another feature of the invention is that because the solder portions 213 and 223 are required to be arranged in one line, it is inevitable to have both the first contacts 22 and the second contacts 21 equipped with offset structures thereof between the contacting portions and the corresponding soldering portions in the transverse direction. In this embodiment, on one hand in the first contact module 30 the first soldering portions 223 are located around a middle region of the housing in the transverse direction even though the contacting portions of the first contacts 22 are essentially located on one side. On the other hand, the second contacts 21 having the contacting portions in the middle region of the housing, have the corresponding soldering portions on one side instead via the corresponding offset structures thereof. Notably, to have the soldering portions of both the first contacts 22 and the second contacts 21 controllably aligned/coplanar with each other, the second insulator 12 forms a positioning cutout 121 to snugly receive the positioning protrusion 111.

What is claimed is:

1. An electrical connector comprising:

an insulative housing defining a mating chamber forwardly opening to an exterior along a front-to-back direction;

a plurality of contacts retained to the insulative housing and arranged along a transverse direction perpendicular to the front-to-back direction, each of the contacts including a contact portion extending into the mating chamber; and a shielding plate having a pair of latch arms located at two opposite lateral sides of the mating chamber; wherein the shielding plate includes a pair of retention arms each including an interference protrusion fixed to the insulative housing; wherein said insulative housing comprising a front insulator, a first rear insulator and a second rear insulator mounted on two opposite sides of the shielding plate, the front insulator defines the mating chamber, and the retention arms engage with the front insulator by interference fit; wherein said contacts includes a row of first contacts insert molded with the first rear insulator and a row of second contacts insert molded with the second rear insulator; wherein the front insulator has a top face, a bottom face and a plurality of receiving grooves going through corresponding top and bottom faces to receive the corresponding first and second contacts; wherein the first rear insulator and the second rear insulator are configured to be assembled to the front insulator in opposite vertical directions and commonly vertically sandwich the front insulator therebetween.

2. The electrical connector as claimed in claim 1, wherein said shielding plate has a planar body with a front surface, and said retention arms protrude forwardly beyond the front surface to form a retention cutout therebetween.

3. The electrical connector as claimed in claim 2, wherein said front surface includes a first front surface located between the retention arms and a second front surface located between the retention arm and the latch arm, and the first front surface is in front of the second front surface.

4. The electrical connector as claimed in claim 1, wherein the front insulator includes a rear face and two fixing grooves going through the rear face along the front-to-back direction, the retention arms are received in the corresponding fixing grooves in a hidden manner, and the interference protrusions engage to the inner wall of the fixing grooves by interference fit.

5. The electrical connector as claimed in claim 4, wherein said front insulator includes two lateral sides and two escape grooves going therethrough along the transverse direction, respectively, the escape grooves communicating to the mating chamber and located outside of the fixing grooves, the latch arms received in the corresponding escape grooves, respectively.

6. The electrical connector as claimed in claim 1, wherein each of the first contacts has a first soldering tail extending backwardly out of the first rear insulator, each of the second contacts has a second soldering tail extending backwardly out of the second rear insulator, and the first and second soldering tails are arranged in a row along the transverse direction.

7. The electrical connector as claimed in claim 1, wherein the front insulator has a pair of receiving slots behind the receiving grooves to receive positioning projections formed on the first and second rear insulators.

8. The electrical connector as claimed in claim 1, wherein the first rear insulator includes a rear edge and a positioning cutout recessed therefrom, the second rear insulator includes a positioning protrusion received in the positioning cutout, and the second soldering portions extend backwardly from the positioning protrusion.

9. The electrical connector as claimed in claim 1, wherein said interference protrusion are disposed in a face-to-face way.

10. The electrical connector as claimed in claim 1, wherein said interference protrusions are fixed to a middle portion of the insulative housing.

11. An electrical connector comprising:

an insulative housing including a front insulator, a first rear insulator and a second rear insulator assembled together, said front insulator forming a mating cavity communicating forwardly with an exterior along a front-to-back direction;

a metallic shell enclosing said housing;

a plurality of first contacts integrally formed with the first rear insulator via an insert-molding process, each of said first contacts including a front first contacting portion extending into the mating cavity, and a rear first soldering portion;

a plurality of second contacts integrally formed with the second rear insulator via another insert-molding process, each of said second contacts including a front second contacting portion extending into the mating cavity, and a rear second soldering portion; and a metallic shielding plate having a pair of opposite side latching arms extending into the mating cavity, said shielding plate being assembled to the front insulator and intimately sandwiched between the first rear insulator and the second rear insulator in a vertical direction perpendicular to said front-to-back direction so as to have both the first soldering portions and the second soldering portions coplanar with each other in a horizontal plane; wherein the first rear insulator and the second rear insulator are configured to be oppositely assembled to the front insulator in the vertical direction and commonly sandwich the front insulator therebetween in said vertical direction.

12. The electrical connector as claimed in claim 11, wherein the first contacting portions and the second contacting portions are arranged in two rows while both first soldering portions and second soldering portions are arranged in one row along a transverse direction perpendicular to both said front-to-back direction and the vertical direction.

13. The electrical connector as claimed in claim 12, wherein the first contacts having the corresponding contacting portions on one side of the housing in said transverse direction, have the corresponding soldering portion in a middle region of the housing in the transverse direction while the second contacts having the corresponding contacting portions in the middle region of the housing in the transverse direction, have the corresponding soldering portions on one side of the housing in the transverse direction.

14. The electrical connector as claimed in claim 13, wherein both said first contacts and said second contacts have corresponding offset structures in the transverse direction so as to have the corresponding first soldering portions and second soldering portions aligned in one row.

15. The electrical connector as claimed in claim 11, wherein around a middle region of the housing along a transverse direction perpendicular to both said front-to-back direction and said vertical direction, said first rear insulator forms a positioning protrusion around the first soldering portions, and said second rear insulator form a positioning cutout around the second soldering portions to receive the positioning protrusion.

16. The electrical connector as claimed in claim 11, wherein the front insulator includes a rear face and at least one fixing groove going through the rear face along the front-to-back direction, and the shielding plate includes at least a retention arm located between the pair of side latching arms and securely received in the fixing groove in a hidden manner.

17. An electrical connector comprising:

an insulative housing including a front insulator, a first rear insulator and a second rear insulator assembled together, said front insulator forming a mating cavity communicating forwardly with an exterior along a front-to-back direction;

a metallic shell enclosing said housing;

a plurality of first contacts integrally formed with the first rear insulator via an insert-molding process, each of said first contacts including a front first contacting portion extending into the mating cavity, and a rear first soldering portion;

a plurality of second contacts integrally formed with the second rear insulator via another insert-molding process, each of said second contacts including a front second contacting portion extending into the mating cavity, and a rear second soldering portion; and a metallic shielding plate having a pair of side latching arms extending into the mating cavity, said shielding plate intimately sandwiched between the first rear insulator and the second rear insulator in a vertical direction perpendicular to said front-to-back direction so as to have both the first soldering portions and the second soldering portions coplanar with each other in a horizontal plane; wherein around a middle region of the housing along a transverse direction perpendicular to both said front-to-back direction and said vertical direction, said first rear insulator forms a positioning protrusion around the first soldering portions, and said second rear insulator form a positioning cutout around the second soldering portions to receive the positioning protrusion.

18. The electrical connector as claimed in claim 17, wherein said shielding plate is configured to be forwardly assembled to the front insulator while both said first rear insulator and said second rear insulator are configured to be assembled to the front insulator in the vertical direction.

19. The electrical connector as claimed in claim 17, wherein the first contacting portions and the second contacting portions are arranged in two rows while both first soldering portions and second soldering portions are arranged in one row along said transverse direction, and wherein the first contacts having the corresponding contacting portions on one side of the housing in said transverse direction, have the corresponding soldering portion in a middle region of the housing in the transverse direction while the second contacts having the corresponding contacting portions in the middle region of the housing in the transverse direction, have the corresponding soldering portions on one side of the housing in the transverse direction.

20. The electrical connector as claimed in claim 17, wherein the front insulator includes a rear face and at least one fixing groove going through the rear face along the front-to-back direction, and the shielding plate includes at least a retention arm located between the pair of side latching arms and securely received in the fixing groove in a hidden manner.

* * * * *